US005569528A

United States Patent [19]

Van der Loo et al.

[11] Patent Number: 5,569,528

[45] Date of Patent: Oct. 29, 1996

[54] NON-WOVEN LAYER CONSISTING SUBSTANTIALLY OF SHORT POLYOLEFIN FIBERS

[75] Inventors: Leonardus L.H. Van der Loo, Beek; René C. Van der Burg, Heerlen, both of Netherlands

[73] Assignee: DSM N.V., Netherlands

[21] Appl. No.: 318,783

[22] PCT Filed: Mar. 31, 1993

[86] PCT No.: PCT/NL93/00078

§ 371 Date: Oct. 3, 1994

§ 102(e) Date: Oct. 3, 1994

[87] PCT Pub. No.: WO93/20271

PCT Pub. Date: Oct. 14, 1993

[30] Foreign Application Priority Data

Apr. 3, 1992 [NL] Netherlands ..... 9200625

[51] Int. Cl.[6] ..... G32B 5/06

[52] U.S. Cl. ..... 428/298; 19/163; 28/103; 28/107; 28/116; 28/117; 428/221; 428/224; 428/280; 428/284; 428/286; 428/297; 428/299; 428/373; 428/400; 428/911; 428/102

[58] Field of Search ..... 428/221, 224, 428/280, 282, 284, 286, 234, 300, 400, 297, 298, 299, 373, 911, 246, 102; 19/163; 28/103, 107, 116, 117

[56] References Cited

U.S. PATENT DOCUMENTS

| | | |
|---|---|---|
| 3,641,638 | 2/1972 | Laible . |
| 4,413,110 | 11/1983 | Kavesh . |
| 4,457,985 | 7/1984 | Harpell et al. . |
| 4,623,574 | 11/1986 | Harpell et al. . |
| 4,650,710 | 3/1987 | Harpell . |
| 4,820,568 | 4/1989 | Harpell et al. . |
| 5,035,111 | 7/1991 | Hogenboom . |
| 5,035,952 | 7/1991 | Bruinink . |
| 5,135,804 | 8/1992 | Harpell et al. . |

FOREIGN PATENT DOCUMENTS

| | | |
|---|---|---|
| A2042414 | 9/1980 | United Kingdom . |
| A2051667 | 1/1981 | United Kingdom . |
| A8703674 | 6/1987 | WIPO . |
| A8901126 | 2/1989 | WIPO . |
| A9104855 | 4/1991 | WIPO . |

OTHER PUBLICATIONS

Laible & Figucia, 'The Application of High–Modulus Fibers to Ballistic Protection', J. Macromol. Sci.–Chem. A7(1), pp. 295–322 (1973).

Laible, 'Ballistic Materials and Pentration Mechanics', vol. 5 of Methods and Phenomena: Their Applications in Science and Technology, Elsevier Scientific Publishing Co., (1980).

Liable, 'High Speed Testing as a Measure of the Resistance to Penetration of Needle–Punched Felts', Journal of Applied Polymer Science, vol. 8, pp. 283–295 (1964).

Database WPI, Section Ch, Week 1692, Derwent Publications Ltd., London, GB.

Database WPI, Section Ch, Week 1292, Derwent Publications Ltd., London, GB.

Database WPI, Section Ch, Week 3289, Derwent Publications Ltd., London, GB.

*Primary Examiner*—James J. Bell

*Attorney, Agent, or Firm*—Cushman Darby & Cushman, L.L.P.

[57] ABSTRACT

The invention relates to a non-woven layer that consists substantially of short polyolefin fibers the nonwoven layer being a felt with in the plane of the layer substantially randomly oriented fibers with a length of 40–100 mm, a tensile strength of at least 1.2 GPa and a modulus of at least 40 GPa. The invention also relates to a method for the manufacture of this felt and to layered structures in which the felt is used. Layered structures comprising a non-woven layer according to the invention have improved specific energy absorption on impact of ballistic projectiles.

19 Claims, No Drawings

NON-WOVEN LAYER CONSISTING SUBSTANTIALLY OF SHORT POLYOLEFIN FIBERS

The invention relates to a non-woven layer that consists substantially of short polyolefin fibres. Such a non-woven layer is known from WO-A-89/01126. This known layer consists of polyolefin fibres, having a length of at most 20.3 cm, which are substantially unidirectionally oriented and are embedded in a polymeric matrix. This known layer is used in layered ballistic-resistant structures.

A drawback of this layer is that the specific energy absorption (SEA), that is the energy absorbtion on ballistic impact divided by the areal density (weight per $m^2$), is still low. Because of this the ballistic-resistant layer must have a high weight per $m^2$ to offer sufficient protection against ballistic impacts. A further drawback is that the layer comprises a matrix, as a result of which it is less flexible and does not breathe as well. Because of this, ballistic-resistant clothing, such as fragment-resistant and bulletproof vests, in which this layer is incorporated is not very comfortable to wear.

The aim of the invention is to avoid these drawbacks to a substantial extent.

This aim is achieved because the non-woven layer is a felt having in the plane of the layer substantially randomly oriented short fibres with a length of 40–100 mm, a tensile strength of at least 1.2 GPa and a modulus of at least 40 GPa.

A felt is a layer wherein the individual fibres are not assembled together to form a specific structure like obtained when yarns are knitted or woven and which layer does by definition not comprise a matrix.

Surprisingly, it has been found that this layer has an improved specific energy absorption (SEA) and is hence very suitable for use in a layered ballistic-resistant structure, in particular for protection against (shell) fragments.

'Good ballistic-resistant properties' is hereinafter understood to be in particular a high SEA. In the field of layered ballistic-resistant structures 'high SEA' is generally understood to be an SEA of more than 35 $Jm^2/kg$. The SEA is determined according to test standard Stanag 2920 using a fragment-simulating projectile of 1.1±0.02 g. The SEA of the non-woven layer according to the invention is preferably more than 40 $Jm^2/kg$ and more preferably more than 50 $Jm^2/kg$ and most preferably more than 60 $Jm^2/kg$.

The advantage of a high SEA is that fragments with a certain velocity can be arrested by a layer with a substantially lower areal density. A low areal density is very important for increasing the comfort in wearing, which, besides good protection, is the main aim in developing new materials in ballistic-resistant clothing.

A further major advantage of the use of the nonwoven layer according to the invention in ballistic-resistant clothing is that it does not comprise a matrix and is hence more flexible and more easily adaptable to the shape of the body and can moreover breathe, so that perspiration vapour can easily be discharged.

An additional advantage is that the structure of the invention can be produced via a simpler process that can be carried out using conventional and commercially available equipment.

Although the aforementioned advantages of the invention are pre-eminently advantageous in the aforementioned ballistic-resistant clothing such as fragment-resistant and bullet-proof vests, the use of the invention is not limited thereto. Other applications are in for example bomb blankets and panels.

WO-A-91/04855 discloses a felt consisting of a mixture of 2 different types of short polyolefin fibres, one type of which is substantially shorter and of a polyolefin material having a lower melting temperature than the other type. The felt is converted to a ballistic-resistant article by sintering or melting of the short fibres which are formed into a matrix embedding the long fibres. The drawbacks of this article are that it is not very flexible because of the rigid bonding of the long fibres and that it has mediocre ballistic-resistant properties. Another important difference with respect to the present invention is that WO-A-91/04855 uses fibres with a length of at least 12.7 mm.

US-A-4623574 mentions the use of felt layers of non-woven polyolefin fibres in an ballistic-resistant application. However the use of short fibres was not mentioned. Further it is stated here that a minimum content (of at least about 13 wt.%) of matrixmaterial is required in the layer to obtain a layer with good ballistic-resistant properties, with all of the aforementioned drawbacks relative to the present invention that it entails.

The non-woven layer of the invention consists substantially of short polyolefin fibres. With "substantially" is meant here that the non-woven layer may comprise minor amounts of other constituents, not including a matrix. These other constituents may for example be short fibers of an other material. It was found that other constituents negatively influence the good results achieved by the present invention. Preferably the amount of other constituent is less than 20 % more preferably less than 10 % and even more preferably less than 5% and most preferably 0% (% by volume).

It has been found that the ballistic-resistant properties improve with the fineness of the fibres. The fineness of the fiber is the weight per unit length of fiber (in denier). Good results are obtained if the fineness of the fibres is between 0.5 and 12 denier. It is difficult to process fibres that are finer than 0.5 denier into a felt. Felts consisting substantially of fibres with a fineness of more than 12 denier have poorer ballistic-resistant properties and a poorer compactness. Preferably, the fineness is between 0.5 and 8 denier, more preferably the fineness is between 0.5 and 5 denier and most preferably the fineness is between 0.5 and 3 denier.

Preferably the fibers are crimped. A felt consisting substantially of crimped fibers has better mechanical and ballistic-resistant properties. Crimped short polyolefin fibres can be obtained from crimped polyolefin filaments with a tensile strength of at least 1.2 GPa and a modulus of at least 40 GPa by reducing the latter according to methods known per se, for example by chopping or cutting. Crimped filaments can be obtained in any manner known from the prior art, preferably however with the aid of a stuffer box. The fibre's mechanical properties, for example its tensile strength and modulus, may not substantially deteriorate as a result of the crimping.

Particularly suitable polyolefins are polyethylene and polypropylene homopolymers and copolymers. In addition, the polyolefins used may contain small amounts of one or more other polymers, in particular other alkene-1-polymers.

Good results are obtained if linear polyethylene (PE) is chosen as the polyolefin. Linear polyethylene is here understood to be polyethylene with fewer than 1 side chain per 100 C atoms and preferably with fewer than 1 side chain per 300 C atoms, which can moreover contain up to 5 mol.% one or more copolymerisable other alkenes such as propylene, butylene, pentene, 4-methylpentene and octene.

Preferably, polyolefin fibres consisting of linear polyethylene with an intrinsic viscosity in Decalin at 135° C. of at least 5 dl/g are used in the non-woven layer according to the invention.

The length of the fibres must be between 40 and 100 mm. At a fibre length of less than 40 mm the cohesion, the strength and the SEA of the non-woven layer are too poor. At a fibre length of over 100 mm the SEA and compactness of the non-woven layer are substantially lower. The compactness is the areal density divided by the thickness of the layer. In general, a layer with a higher compactness has a lower blunt trauma effect. The blunt trauma effect is the detrimental effect of the bending of the ballistic-resistant structure as a result of the impact of a projectile. It is important that ballistic-resistant clothing has a low blunt trauma effect besides a high SEA.

It is further important that the fibres have a high tensile strength, a high modulus of elasticity and a high energy absorption. In the non-woven layer of the invention use is to be made of polyolefin fibres the monofilament of which has a strength of at least 1.2 GPa and a modulus of at least 40 GPa. When use is made of fibres with a lower strength and modulus good ballistic-resistant properties cannot be obtained.

The layer of the invention can contain fibres with variously shaped cross sections, for example round, rectangular (tapes) or oval fibres. The shape of the cross section of the fibres can for example also be adjusted by rolling the fibres flat. The shape of the cross section of the fibre is expressed in the cross section's aspect ratio, which is the ratio of the length and the width of the cross section. The cross section's aspect ratio is preferably between 2 and 20, more preferably between 4 and 20. Fibres with a higher aspect ratio show a higher degree of interaction in the non-woven layer, as a result of which they can move less easily relative to one another in the case of a ballistic impact. Because of this an improved SEA of the non-woven layer can be obtained.

The degree of interaction can also be modified by modifying the surface of the fibres. The surface of the fibre can be modified by incorporation of a filler in the fibres. The filler may be an inorganic material, such as gypsum, or a polymer. The surface of the fibre may also be modified via a corona, plasma and/or chemical treatment. The modification may be a toughening of the surface owing to the presence of etching pits, an increase in the polarity of the surface and/or a chemical functionalisation of the surface.

The SEA and the blunt trauma effect of the nonwoven layer can be improved by increasing this the degree of interaction between the fibres. However if the degree of interaction is too great the SEA may decrease again. The optimum can be found by one skilled in the art by routine experimentation.

Good ballistic-resistant properties are obtained according to the invention when the polyolefin fibres described above are substantially randomly oriented in the plane of the non-woven layer. 'Substantially randomly' is understood to mean that the fibers have no preferential orientations leading to different mechanical properties in the plane of the layer. The mechanical properties in the plane of the layer are substantially isotropically, that is, substantially the same in different directions. The spread of mechanical properties in different directions in the plane of the non-woven layer may not exceed 20%, preferably not 10%. More preferably, the spread of the non-woven layer is so that the spread of the layered structure that consists of one or more of the non-woven layers of the invention is less than 10%.

Preferably use is made of polyolefin fibres that are obtained from polyolefin filaments prepared by means of a gel-spinning process as described in for example GB-A-2042414 and GB-A-2051667. This process essentially consists in preparing a solution of a polyolefin with a high intrinsic viscosity, as determined in Decalin at 135° C., spinning the solution to filaments at a temperature above the dissolution temperature, cooling the filaments below the gelling temperature to cause gelling and removing the solvent before, during or after the stretching of the filaments.

The shape of the cross section of the filaments can be chosen by chosing a corresponding shape of the spinning aperture.

The non-woven layer of the invention can be used in ballistic-resistant structures in different ways. The non-woven layer of the invention can be used as such, as a single layer.

A particular application of the invention is in a layered structure consisting of at least two non-woven layers according to the invention which are entangled together. The advantage of this application is that this layered structure is more compact and easier to handle than a single non-woven layer.

Another particular application of the invention is in a layered structure consisting of one or more nonwoven layers according to the invention and one or more woven fabrics which are entangled together. The woven layer preferably has also good ballistic-resistant properties. The woven layer preferably consists of polyolefin filaments having a tensile strength of at least 1.2 GPa and a modulus of at least 40 GPa. The advantage of such a layered structure is that it is very compact and has a low blunt trauma effect besides an improved SEA. The layers in the layered structures described above may be entangled together by needling, hydroentanglement or stitching.

A layered structure for ballistic-resistant use may comprise one of more of the non-woven layers or of the layered structures described above. The number of layers in the layered structure depends on the level of protection required. In application in ballistic-resistant clothing the choice of the number of layers and thus the areal density of a layered ballistic-resistant structure is a difficult trade-off of on the one hand the desired level of protection and on the other on the desired comfort in wearing. The comfort in wearing is mainly determined by the weight and thus the areal density of the ballistic resistant structure. A particular advantage of the non-woven layer of the present invention is that a progressively higher SEA is obtained at lower areal densities. Because of this, the non-woven layer of the invention is particularly advantageous in application in ballistic-resistant structures for the lower and medium protection level range (V50 from 450– 500 m/s) because of the very light weight (low areal density) and hence higher comfort to wear. The advantages of the non-woven layer of the present invention are in particular apparent in layered structures consisting of a stack of non-woven layers and having an areal density below 4 $kg/m^2$, or more preferably below 3 $kg/m^2$ or most preferably below 2 $kg/m^2$. Layered structures with a high areal density are preferably formed by losely stacking a large number of layers having a very small areal density.

The non-woven felt layers or the layered structures can be combined with layers of a different type that can contribute towards certain other specific ballistic-resistant properties or other properties. The drawback of the combination with layers of a different type is that the SEA and the comfort in wearing, among other properties, will deteriorate. Preferably, the entire structure therefore consists of non-woven layers or the aforementioned layered structures. Preferably, such a layered structure has a thickness of between 10 and 30 mm.

The non-woven layer can be manufactured by several techniques like for example by paper-making techniques such as passing an aqueous slurry of the fibers onto a wire screen and dewatering. Preferably however the non-woven layer is manufactured by a method comprising the carding of a mass of loose short polyolefin fibres having a tensile strength of at least 1.2 GPa, a modulus of at least 40 GPa and a length of between 40 and 100 mm, the fibres being substantially unidirectionally oriented and being formed into a carded non-woven web;

the feeding of the carded non-woven web obtained to a discharge device moving in a direction perpendicular to that in which the web is fed to it, onto which the web is deposited in zigzag folds, while being simultaneously discharged, so that in the discharge direction a stacked layer is formed that consists of a number of stacked layers of the supplied carded nonwoven web that partially overlap one another widthwise;

the calendering of the stacked layer, in which the thickness of the layer is reduced;

the stretching of the calendered layer obtained in the discharge direction;

the entangling of the stretched layer obtained to form a felt layer.

This appears to result in a non-woven layer in the form of a felt having improved ballistic-resistant properties, in particular a specific energy absorption of more than 35 $Jm^2/kg$, in particular more than 40 $Jm^2/kg$ and more in particular more than 50 $Jm^2/kg$.

Preferably the short polyolefin fibers are crimped.

The crimped fibres can be obtained by subjecting polyolefin filaments having the desired mechanical properties and fineness, which can be obtained using methods known per se and mentioned above, to treatments for crimping known per se. An example of a known crimping method is treatment of the filaments in a stuffer box. The crimped fibres thus obtained must then be cut to the desired length, between 40 and 100 mm. In this cutting a compressed mass of fibres is often obtained. This mass must be disentangled (opened) by for example mechanical combing or blowing. In this process the composed fibres, which are obtained when use is made of multifilaments, are simultaneously disentangled to substantially single fibres. The advantage of using crimped fibres in the method described above is that crimped fibers are more easily disentangled (opened) after cutting and are more easy to card into a web.

The carding can be done with the usual carding machines. The thickness of the layer of fibres that is fed to the carding device may be chosen within wide limits; it is substantially dependent on the desired areal density of the felt ultimately to be obtained. In particular, allowance must be made for the stretching to be carried out at a later stage in the process, in which the areal density will decrease dependent on the chosen draw ratio.

The carded non-woven web is stacked in zigzag folds onto a discharge device that moves in a direction perpendicular to that in which the carded non-woven web is fed to it. This direction is the discharge direction. The discharge device may be for example a conveyor belt, whose transport speed is chosen so relative to the supply rate of the carded non-woven web that a stacked layer comprising the desired number of partially overlapping layers is obtained.

The orientation of the fibres in the stacked layer depends on the ratio of the aforementioned supply rate and transport speed and the ratio of the width of the carded web and the width of the stacked layer. The fibres will be oriented substantially in two directions, which are determined by the zigzag pattern.

The calendering of the stacked layer can be carried out using the known devices. The thickness of the layer decreases in the process and the contact between the individual fibres becomes closer.

Then the calendered layer is stretched lengthwise, i.e. in the discharge direction. This causes the surface area to increase so that the thickness and hence the areal density of the stretched layer can decrease slightly. The draw ratio is preferably between 20 and 100%.

It has been found that the orientation of the fibres in the plane of the layer becomes substantially random in the stretching process.

The cohesion, the strength and the compactness of the stretched layer are increased by entangling this layer. This entangling can be done by needling the layer or by hydroentangling. In the case of needling the felt is pierced with needles having fine barbs that draw fibres through the layers. The needle density may vary from 5 to 50 needles per $cm^2$. Preferably the needle density is between 10 and 20 needles per $cm^2$. In the case of hydroentangling the stretched layer is pierced with a plurality of fine high-pressure streams of water. The advantage of hydroentangling over needling is that the fibres are damaged less. Needling presents the advantage that it is a technically simpler process.

Further compacting of the felt can be carried out by subjecting the stretched layer and/or the felt to an additional needling or calendering step. The result of the additional needling or calendering of the felt layer is that the felt becomes more compact, which presents the advantage that the blunt trauma effect is reduced without the SEA being unacceptably lowered. It has been found that the entangling also helps to increase the randomness of the orientation of the fibres and the isotropy of mechanical properties in the plane of the layer.

The thickness of the felt layer is determined by the areal density of the mass of loose short fibres fed to the carding device in relation to the number of stacked carded non-woven webs and the decrease in thickness that occurs during the calendering, stretching and entangling. Thick layers of felt can be obtained by increasing the layer thickness at the beginning of the process or by compacting less in the aforementioned process steps. A thicker, compact felt can also be obtained by stacking several layers of felt and then entangling them together, for example via needling. The advantage of a thicker compact felt is that besides having a high SEA, it has a lower blunt trauma effect and can be handled more easily than a single thick non-woven layer.

In a particularly advantageous embodiment the felt obtained is needled together with fabrics or other types of layers. These hybrid structures are much thinner and have a low blunt trauma effect besides a greatly improved fragment-resistance.

The non-woven layers thus obtained or their particular embodiments described above can be combined in a layered ballistic-resistant structure with layers of a different type that can contribute towards certain other specific ballistic-resistant properties or other properties in order to increase the specific energy absorption thereof.

The invention is further elucidated with reference to the following examples without being limited thereto. The quantities mentioned in the examples are determined in the following manners.

The tensile strength and the modulus are determined by means of a tensile test carried out with the aid of a Zwick 1484 tensile tester. The filaments are measured without twist. The filaments are clamped over a length of 200 mm in Orientec (250-kg) yarn clamps, with a clamping pressure of 8 bar to prevent slipping of the filaments in the clamps. The crosshead speed is 100 mm/min. The 'modulus' is understood to be the initial modulus. This is determined at 1% elongation. The fineness is determined by weighing a fibre with a known length.

The thicknesses (T) of the felt layers were measured in compressed condition, using a pressure of 5.5 KPa. The areal density (AD) was determined by weighing a part of a layer with an accurately determined area.

The specific energy absorption (SEA) is determined according to the STANAG 2920 test, in which .22 calibre FSPs (Fragment Simulating Projectiles), hereinafter referred to as fragments, of a non-deforming steel of specified shape, weight (1.1 g), hardness and dimensions (according to US MIL-P-46593), are shot at the ballistic-resistant structure in a defined manner. The energy absorption (EA) is calculated from the kinetic energy of the bullet having the $V_{50}$ velocity. The $V_{50}$ is the velocity at which the probability of the bullets penetrating the ballistic-resistant structure is 50%. The specific energy absorption (SEA) is calculated by dividing the energy absorption (EA) by the areal density (AD) of the layer.

EXAMPLE I

A polyethylene multifilament yarn (Dyneema SK60® ) with a tensile strength of 2.65 GPa, an initial modulus of 90 GPa, a fineness of 1 denier per monofilament and an aspect ratio of the fibre cross section of about 6 was crimped in a stuffer box. The crimped filaments were cut into 60-mm long fibres. The fibres obtained were supplied to a carding machine in a layer thickness of 12±3 g/m$^2$ . The carded non-woven web obtained was stacked in zigzag folds onto a conveyor belt, the ratio of the speed of the belt and the supply rate of the carded non-woven web fed to it at right angles being chosen so that an approximately 2-m wide layer consisting of 10 stacked nonwoven webs was obtained. The stacked layer was calendered under light pressure in a belt calender, which resulted in a more compact and thinner calendered layer. The calendered layer was stretched 38% lengthwise. The stretched layer was compacted by needling using 15 needles/cm$^2$ . The areal density of the felt thus obtained was 120 g/m$^2$. 22 layers of this felt, hereinafter referred to as $F_0$, were stacked to form a ballistic-resistant structure, $F_1$, with an areal density of 2.6 kg/m$^2$ and a thickness of 23 mm.

EXAMPLE II

Felt $F_0$, as obtained according to example I, was subjected to additional needling using 15 needles/cm$^2$ to compact the felt. 22 layers of this felt were stacked to obtain a ballistic-resistant structure, $F_2$, with an areal density of 2.7 kg/m$^2$ and a layer thickness of 22 mm.

EXAMPLE III

Felt $F_0$, as obtained according to example I, was subjected to additional calendering in order to compact it further. Then a number of these layers were stacked to obtain a ballistic-resistant structure ($F_3$) with an areal density of 3.1 kg/m$^2$ and a layer thickness of 20 mm.

EXAMPLE IV

An extra heavy and compact felt was manufactured by stacking 3 layers of felt $F_0$, as obtained according to example I, and needling them together, using 15 needles per cm$^2$ . Then a number of the layers thus obtained were stacked to obtain a ballistic-resistant structure ($F_4$) with an areal density of 2.9 kg/m$^2$ and a layer thickness of 20 mm.

EXAMPLE V

A felt was manufactured as described in example I, only now the entangling was effected with the aid of high-pressure streams of water. Then a number of the layers thus obtained were stacked to obtain a ballistic-resistant structure ($F_5$) with an areal density of 2.6 kg/m$^2$ and a layer thickness of 20 mm.

EXAMPLE VI

A number of layers of felt $F_0$, as obtained according to example I, were needled together with a Dyneema 504® fabric to obtain a ballistic-resistant structure, $F_6$, with an areal density of 2.6 kg/m$^2$ and a layer thickness of 8 mm. Dyneema 504® is a 1×1 plain woven fabric, supplied by DSM, of 400 denier Dyneema SK66® yarn, having a warp and weft of 17 threads per centimeter and an areal density of 175 g/m$^2$.

EXAMPLES VII AND VIII

A felt was manufactured according to the method of example I, only now using fibres with a length of 90 mm instead of 60 mm. A number of layers of the felt thus obtained were combined to obtain ballistic structures $F_7$ and $F_8$, having areal densities of 2.7 kg/m$^2$ and 2.6 kg/m$^2$ and thicknesses of 3.2 and 4.8 cm, respectively. Structure $F_7$ underwent an additional needling step and is therefore more compact and thinner than $F_8$.

EXAMPLE IX

A felt was manufactured according to the method of example I except that the smaller number of felt layers $F_0$ were stacked to obtain a ballistic-resistant structure $F_9$ with an areal density of 1.5 kg/m$^2$ and a layer thickness of 10 mm.

COMPARATIVE EXPERIMENTS 1 AND 2

A number of layers of the Dyneema 504™ fabric specified above was stacked to obtain ballistic-resistant structures C1 and C2 having areal densities of 2.9 kg/m$^2$ and 4.5 kg/m$^2$, respectively.

COMPARATIVE EXPERIMENTS 3–7

Examples 1–5 of Table 1 of the aforementioned patent application WO-A-89/01126 were taken as comparative examples C3 through C7. The values given in this patent for the specific energy absorption and the areal density are based on the fibre weight only. In order to be able to compare these values with the examples of the present invention, the figures have been standardized to total areal density and total specific energy absorption by dividing and multiplying the AD and SEA values, respectively, by the fibre mass fraction.

Specimens of 40 by 40 cm were cut from the ballistic-resistant structures F1–F8 and C1–C2 described above, which were then tested to determine their ballistic-resistant properties by measuring the $V_{50}$, according to the STANAG 2920 test described above. The ballistic-resistant structures of comparative examples C3–C7 of patent application WO-A-89/01126 were tested according to the same standard. Table 1 shows the results.

TABLE 1

| | AD kg/m² | $V_{50}$ m/s | SEA Jm²/kg | T mm |
|---|---|---|---|---|
| F1 | 2.6 | 544 | 63 | 23 |
| F2 | 2.7 | 526 | 59 | 22 |
| F3 | 3.1 | 486 | 50 | 20 |
| F4 | 2.9 | 490 | 51 | 20 |
| F5 | 2.6 | 500 | 53 | 20 |
| F6 | 2.6 | 445 | 42 | 8 |
| F7 | 2.7 | 440 | 39 | 32 |
| F8 | 2.6 | 474 | 48 | 48 |
| F9 | 1.5 | 478 | 86 | 10 |
| C1 | 2.9 | 450 | 39 | 8 |
| C2 | 4.5 | 520 | 34 | 13 |
| C3 | 6.1 | 621 | 35 | —* |
| C4 | 6.9 | 574 | 26 | — |
| C5 | 6.9 | 584 | 27 | — |
| C6 | 6.6 | 615 | 32 | — |
| C7 | 6.3 | 571 | 29 | — |

*Not specified in WI-A-89/01126

Comparison of the results shows that all of the ballistic-resistant layered structures F1–F9 that comprise at least one non-woven layer of the invention show a better specific energy absorption than the best ballistic-resistant structure of C1–C7 according to the state of the art. The SEA values of felts F7 and F8, which contain 90 mm fibres, are lower than those of felt structures F1–F5, which contain 60-mm fibres, but comparable with or better than and in most cases much better than those of structures C1–C7 so far known. F6 has a lower SEA because of its specific structure and lower package thickness. The SEA is however significantly higher than that of the best known ballistic-resistant structure of comparative examples C1–C7. Felt F9 has at approximately half of the areal density even a higher ballistic-resistance than structure C1. Comparison of felt F9 with felts F1–F8 shows that at lower areal density a progressively higher SEA can be obtained.

We claim:

1. A non-woven layer comprising short polyolefin fibers having a tensile strength of at least 1.2 GPa and a modulus of at least 40 GPa, wherein the non-woven layer is a matrix-free felt comprising at least 80% (by volume) of short polyolefin fibers which are substantially randomly oriented in the plane of the non-woven layer and have a length of 40– 100 mm.

2. A non-woven layer according to claim 1, wherein the non-woven layer consists of the short polyolefin fibers.

3. A non-woven layer according to claim 1, wherein in that the fibres have a fineness of between 0.5 and 12 denier.

4. A non-woven layer according to claim 1, wherein the fibres are crimped.

5. A non-woven layer comprising short polyolefin fibers having a tensile strength of at least 1.2 GPa and a modulus of at least 40 GPa, characterised in that the non-woven layer is a felt consisting of the short polyolefin fibers which are substantially randomly oriented in the plane of the matrix-free non-woven layer and which are crimped, have a length of 40–100 mm and have a fineness of between 0.5 and 8 denier.

6. A non-woven layer according to claim 2, wherein the polyolefin fibres in the non-woven layer consist of linear polyethylene with an intrinsic viscosity in Decalin at 135° C. of at least 5 dl/g.

7. A non-woven layer according to claim 2, wherein the aspect ratio of the cross section of the fibres is between 2 and 20.

8. A non-woven layer according to claim 2, wherein the surface of the fibres is modified through corona or plasma treatment or through chemical functionalisation or through filling of the fibre.

9. Non-woven layer comprising short polyolefin fibers having a tensile strength of at least 1.2 GPa and a modulus of at least 40 GPa, characterized in that the non-woven layer is a felt comprising at least 80% (by volume) of short polyolefin fibers which are substantially randomly oriented in the plane of the non-woven layer, wherein said fibers are crimped and have a length of 40–100 mm, a fineness of between 0.5 and 12 denier, and consist of linear polyethylene with an intrinsic viscosity in Decalin at 135° C. of at least 5 dl/g, and said non-woven layer has a specific energy absorption of at least 40 J.m²/kg.

10. A layered structure consisting of at least two non-woven layers according to claim 1, 5 or 9, which are entangled together.

11. A layered structure consisting of at least two non-woven layers according to claim 1, 5 or 9 and one or more woven layers which are entangled together.

12. A layered structure comprising at least one non-woven layer according to claim 1, 5 or 9.

13. A layered structure consisting of at least two non-woven layers according to claims 1, 5 or 9, wherein the layered structure has a thickness of between 10 and 30 mm.

14. Ballistic resistant article which is a clothing, a vest, a bomb-blanket or a panel comprising a non-woven layer according to any of claims 1, 5 or 9 as a ballistic protective layer.

15. A matrix-free non-woven layer consisting essentially of short polyolefin fibers having a tensile strength of at least 1.2 GPa, wherein said matrix-free non-woven layer is a felt consisting essentially of at least 80% by volume of short polyolefin fibers which are substantially randomly oriented in the plane of the non-woven layer and have a length of 40–100 mm and said non-woven layer having a specific energy absorption of at least 40 J.m²/kg.

16. Method for the manufacture of a non-woven layer comprising the steps of carding a mass of loose short polyolefin fibres into a carded nonwoven web, said loose short fibres having a tensile strength of at least 1.2 GPa, a modulus of at least 40 GPa and a length of between 40 and 100 mm, and a substantially unidirectional orientation;

feeding the carded non-woven web to a discharge device moving in a direction perpendicular to that in which the non-woven web is supplied, onto which the web is deposited in zigzag folds while being simultaneously discharged, so that in the discharge direction a stacked layer is formed that consists of a number of stacked layers of the supplied carded non-woven web that partly overlap one another widthwise;

calendering the stacked layer, in which the thickness of the layer is reduced, to obtain a calendered layer;

stretching the calendered layer in the discharge direction of the calendered layer obtained;

entangling the stretched layer to form a felt layer.

17. A method according to claim 16, wherein the fibres are crimped fibres having a fineness of between 0.5 and 8 denier.

18. A method according to claim 16 or 17, wherein the entangling is effected through needling or hydroentangling.

19. A method according to claim 14, wherein at least the stretched layer of the felt layer is compacted.

* * * * *

UNITED STATES PATENT AND TRADEMARK OFFICE

CERTIFICATE OF CORRECTION

PATENT NO. : 5,569,528

DATED : October 29, 1996

INVENTOR(S) : VAN DER LOO et al.

It is certified that error appears in the above-indentified patent and that said Letters Patent is hereby corrected as shown below:

In column 3, line 39, delete "toughening" and insert --roughening--.

In Claim 19, change "claim 14" to read --claim 16--.

Signed and Sealed this

Twenty-ninth Day of April, 1997

*Attest:*

*Attesting Officer*

Bruce Lehman

BRUCE LEHMAN

*Commissioner of Patents and Trademarks*